US005852935A

United States Patent [19]

Christensen et al.

[11] Patent Number: 5,852,935

[45] Date of Patent: Dec. 29, 1998

[54] CONTROL VALVE

[75] Inventors: Carsten Christensen, Broager; Carl Christian Dixen, Sydals, both of Denmark

[73] Assignee: Danfoss A/S, Nordborg, Denmark

[21] Appl. No.: 933,439

[22] Filed: Sep. 18, 1997

[30] Foreign Application Priority Data

Sep. 28, 1996 [DE] Germany ..... 196 40 103.8

[51] Int. Cl.[6] ..... F15B 13/02

[52] U.S. Cl. ..... 60/452; 60/422

[58] Field of Search ..... 60/452, 422

[56] References Cited

U.S. PATENT DOCUMENTS 5,279,121 1/1994 Barber ..... 60/452

5,673,557 10/1997 Yoshida et al. ..... 60/452

*Primary Examiner*—Sheldon J. Richter

*Attorney, Agent, or Firm*—Lee, Mann, Smith, McWilliams, Sweeney & Ohlson

[57] ABSTRACT

The invention concerns a control valve with a housing, having a pump connection, a tank connection device, a working connection device and a load pressure connection device, each connected with an opening device in a control surface, and with a slide, arranged movably in the housing and co-operating with the control surface, the slide having grooves and/or channels, so that it connects or separates predetermined opening devices with/from each other. In such a control valve the tightness must be improved. For this purpose an additional auxiliary tank connection device is provided, which is connected with an auxiliary tank opening device in the control surface. The slide has an auxiliary tank pipe or groove, which, in its neutral position, connects the auxiliary tank opening device with the load pressure opening device.

5 Claims, 1 Drawing Sheet

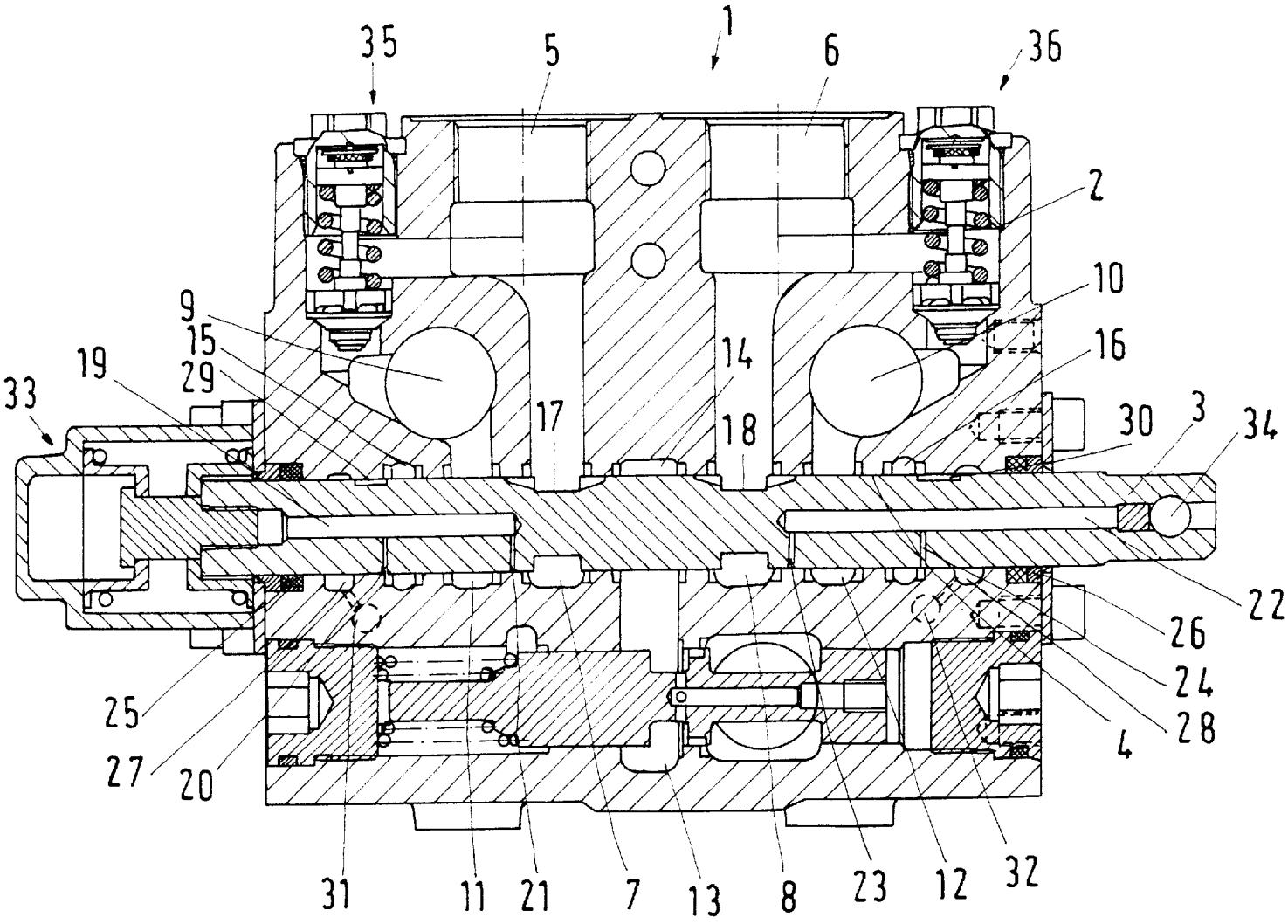
1
2
3
4
5
6
7
8
9
10
11
12
13
14
15
16
17
18
19
20
21
22
23
24
25
26
27
28
29
30
31
32
33
34
35
36

CONTROL VALVE

BACKGROUND OF THE INVENTION

The invention concerns a control valve with a housing having a pump connection, a tank connection device, a working connection device and a load pressure connection device, each connected with an opening device in a control surface and with a slide, arranged movably in the housing and co-operating with the control surface, by which the slide is provided with grooves and/or channels in a way that it connects or separates predetermined opening devices with/from each other in dependence of the slide position.

Such a control valve is, for example, known from the valve PVG 32 of Danfoss A/S, Nordborg, Denmark.

In this valve the working connection device consists of two working connections, which can be connected with a hydraulic consumer. The tank connection device consists of two tank connections, which may under certain circumstances also be combined to one tank connection. The load pressure signal connection device has two load pressure connections, which may under certain circumstances also be combined to one single load pressure connection. Here the two working connections are exposed to the higher of the two pressures, as soon as the slide has left its neutral position, i.e. as soon as it has created a fluid path from the pump connection to one of the working connections.

The load pressure signal signals to the pressure source, e.g. a controlled pump or a pump followed by a pressure control valve, the pressure demand of the consumer connected to the working connection device. When the slide is in its neutral position, this demand will be zero. In accordance with that, the load pressure signal should also assume its lowest value. For this reason it is known to connect the load pressure signal connection device with the tank connection device in the neutral position.

However, this sort of connection implies that in the tank connection device the desired minimum pressure is in fact always available. However, this is not always the case, especially not when a back-pressure valve is arranged in the tank pipe, i.e. the pipe connecting the control valve with a pressure sink. This back-pressure valve can certainly cause a pressure increase also in the tank pipe.

Another problem with such control valves is that it is difficult to provide a good tightness. The risk always exists that hydraulic fluid may escape to the outside between the slide and the housing. This problem can be reduced by providing sealings here. However, at high pressures these sealings are often no more, or only to a limited extent, able to comply with their task.

SUMMARY OF THE INVENTION

The purpose of the invention is to improve the tightness of the valve.

In a control valve of the kind mentioned in the introduction this task is solved according to the invention in that additionally an auxiliary tank connection device is provided, which is connected with an auxiliary tank opening device in the control surface, and that the slide has an auxiliary tank pipe or groove, which, in its neutral position, connects the auxiliary tank opening device with the load pressure opening device.

This feature involves several advantages. Firstly, it is ensured that in the neutral position of the slide the load pressure signal is always maintained at the pressure ruling in the auxiliary tank connection device. This auxiliary tank connection device is separated from the tank connection device and can thus be supplied with a different pressure, e.g. the real tank pressure or the pressure of another pressure sink, which has not been increased by inserted valves, such as a back-pressure valve. Thus the pressure source of this particular control valve can be signalled that the connected consumer has no power demand. However, in addition to this, an additional outlet opportunity is available for the hydraulic fluid reaching the gap between the slide and the housing. The building up of higher pressures, which could lead to a leak in the area of the sealings is thus avoided from the beginning. On the other hand, the function of the control valve is not influenced to lead pressures from the pump connection to one of the two working connections or from the second of the two working connections to the tank connection. Also in other respects the control valve can be kept almost unchanged, i.e. the load pressure connection can be connected with the working connection in which the higher pressure is ruling. Normally, this is the working connection connected with the pump connection.

In a preferred embodiment it is provided that a gap between the slide and the housing is sealed towards the outside by means of a sealing arrangement and the auxiliary tank opening device is arranged next to the sealing arrangement. This practically provides an additional outlet opportunity next to the sealing arrangement for the hydraulic fluid, which has advanced to this point. An additional supply of hydraulic fluid is no longer possible between the auxiliary tank opening device and the sealing arrangement. Thus the tightness is drastically improved. Further to the advantage that practically no hydraulic fluid escapes here any longer, but is led away through the auxiliary tank connection, there is an additional advantage, namely that no pressures can build up, which can counteract the operation power for the slide. Especially when a remote control of the slide is involved, i.e. displacement via an auxiliary drive, a compensation of these counterpressures must no longer be provided.

In this connection it is especially preferable that the auxiliary tank opening device covers the whole length of the sealing arrangement. Then the auxiliary tank opening device forms a reliable blocking. Any fluid that advances to the auxiliary tank opening device is led out. There are no more paths for the hydraulic fluid to advance to the sealing arrangement.

Preferably, the slide is arranged in a cylinder bore in the housing, and at least the auxiliary tank opening device has annular grooves in the wall of the cylinder bore. This is a relatively simple way of forming the slide and the housing. Thus the auxiliary tank connection device can additionally be provided on known control valves, which will only require small modifications.

Preferably, the auxiliary tank connection device is connected with a channel passing through the housing. This enables the application of this control valve also in an arrangement consisting of several control valves. Further to a through-going pump connection and a through-going tank connection, the through-going auxiliary tank connection is also available, through which the auxiliary tank connection device can lead out the emerging hydraulic fluid.

BRIEF DESCRIPTION OF THE DRAWINGS

In the following, the invention is described on the basis of a preferred embodiment in connection with the drawing, showing:

Only FIGURE: a schematic section through a control valve.

DESERTION OF EXAMPLES EMBODYING THE BEST MODE THE INVENTION

A control valve 1 has a housing 2 and a slide 3, arranged axially displaceably in a cylinder bore 4 in the housing 2.

The drawing shows two working connections 5, 6, together forming a working connection device. Each working connection 5, 6 is in connection with a working connection opening 7, 8 in the wall of the cylinder bore 4. Together, these two working connection openings 7, 8 form a working connection opening device.

Further, the drawing shows two tank connections 9, 10, together forming a tank connection device. Each tank connection 9, 10 is in connection with a tank connection opening 11, 12, forming together a tank connection opening device.

A pump connection 13 is connected with a pump opening 14 in the wall of the cylinder 4.

Finally, the wall of the cylinder 4 carries a load pressure opening for each working connection 5, 6, by which each load pressure opening 15, 16 is connected with load pressure connection (not shown) via a channel (not shown). Together the two load pressure connections form a load pressure connection device.

On its surface the slide 3 has a first groove 17 and a second groove 18. In the shown neutral position of the slide 3, the slide 3 separates the pump opening 14 from the working connection openings 7, 8 and these again from the tank connection openings 11, 12. However, when the slide is displaced by a predetermined distance, e.g. to the left, the first groove 17 connects the tank connection opening 11 with the working connection opening 7 and the second groove 18 connects the pump opening 14 with the working connection opening 8. In this case, hydraulic fluid under pressure can flow from pump connection 13 to the second working connection 6 and from there to a connected consumer. Hydraulic fluid returning from the consumer reaches the tank connection 9 through the first working connection 5. When the slide 3 is displaced to the right, the flow direction is opposite.

Further, the slide has a first channel 19, which is connected with the circumference of the slide 3 via two throttle openings 20, 21. In this connection the throttle openings are arranged so that in the neutral position of the slide 3 a pressure is never, or at least only via the pressure in the load pressure opening 15, applied to the channel 19. However, when the slide 3 is displaced so that it connects the working connection 5 with the pump connection 13, the path through the two throttle openings 20, 21 and the channel 19 connects the working connection opening 7 with the load pressure opening 15.

In the same way, a channel 22 on the other side of the slide 3 is connected with the circumference of the slide 3 via two throttle openings 23, 24. Here the same applies for a displacement of the slide 3 in the other direction, i.e. to the left. In this case the working connection 8 is connected with the load pressure opening 16.

On the axial ends of the cylinder bore 4 sealings 25, 26 are arranged, which seal the gap between the housing 2 and the slide 3 towards the outside.

Between the sealings 25, 26 and the load pressure openings 15, 16, auxiliary tank openings 27, 28 are arranged in the wall of the cylinder bore 4, which are formed as annular grooves. Together the two auxiliary tank openings 27, 28 form an auxiliary tank opening device. In the area of the auxiliary tank openings 27, 28 the slide has axial grooves 29, 30, which, in the shown neutral position of the slide, connects the auxiliary tank openings 27, 28 with the load pressure openings 15, 16. When the two load pressure openings 15, 16 are connected elsewhere in the control valve, also one of the two axial grooves 29, 30 can be sufficient.

The auxiliary tank openings 27, 28 are connected with a not shown auxiliary tank connection device, which is directly connected, i.e. without pressure increasing elements, such as back-pressure valves with a pressure sink, e.g. a tank. Any hydraulic fluid advancing to the auxiliary tank openings 27, 28 is immediately led out through these auxiliary tank openings 27, 28, and can thus no longer reach the sealings 25, 26. Correspondingly, a higher pressure cannot be built up here, which could lead to a leakage of the control valve. Preferably, the auxiliary tank connection device is connected with one or two channels passing through the housing, as shown schematically by means of the channels 31, 32. These are running parallel to the tank connections 9, 10 and vertically in relation to the drawing plane. Thus, it is possible to arrange several of such control valves after each other, and flange them to each other, without influencing the advantages of an auxiliary tank connection for all control valves. Instead of providing a housing for each slide, and then connect these housings with each other, several valves, i.e. several slides, can be arranged in a common housing. Such a housing block is also called a monoblock. Also in such a monoblock the tank pipe, the pump pipe and the auxiliary tank pipe for several valves, e.g. four valves, can be provided in common. Of course, it is also possible to combine several such monoblocks, e.g. two valve housings each with four valves to a section with eight valves.

On the left side of the control valve a resetting device 33 for the slide 3 is shown. At the right end of the slide 3 an application opportunity 34 for a displacement mechanism is shown.

Via a refill valve 35 the tank connection 9 is connected with the first working connection 5. In the same way, the tank connection 10 is connected with the second working connection 6 via a refill valve 36.

We claim:

1. Control valve with a housing having a pump connection, a tank connection device, a working connection device and a load pressure connection device, each connected with a respective opening device in a control surface and with a slide, arranged movably in the housing and co-operating with the control surface, the slide having grooves and/or channels so that it connects or separates predetermined opening devices with/from each other in dependence of their position, and including an auxiliary tank connection device, the auxiliary tank connection device being connected with an auxiliary tank opening device in the control surface, and the slide having an auxiliary tank pipe or groove, which, in its neutral position, connects the auxiliary tank opening device with a load pressure opening device.

2. Control valve according to claim 1, in which a gap between the slide and the housing is sealed by means of a sealing arrangement located about the slide at opposite sides of the housing, and the auxiliary tank opening device is arranged next to the sealing arrangement.

3. Control valve according to claim 2, in which the auxiliary tank opening device covers the entire length of the sealing arrangement.

4. Control valve according to claim 1, in which the slide is arranged in a cylinder bore in the housing and at least the auxiliary tank opening device has annular grooves in the wall of the cylinder bore.

5. Control valve according to claim 1, in which the auxiliary tank connecting device is connected to a channel passing through the housing.

* * * * *